US006047704A

United States Patent [19]

Giordano

[11] Patent Number: 6,047,704

[45] Date of Patent: Apr. 11, 2000

[54] SELF-FIXING MULTI-COMB HAIR-CURLER WITH RETENTION CHANNELS

[76] Inventor: Giuseppe Giordano, Chemin de Pernessy 31, CH-1052 Le Mont sur Lausanne, Switzerland

[21] Appl. No.: 09/194,348

[22] PCT Filed: May 30, 1997

[86] PCT No.: PCT/CH97/00218

§ 371 Date: Nov. 24, 1998

§ 102(e) Date: Nov. 24, 1998

[87] PCT Pub. No.: WO97/46133

PCT Pub. Date: Dec. 11, 1997

[51] Int. Cl.[7] ..... A45D 24/10

[52] U.S. Cl. ..... 132/122; 132/139; 132/261; 132/262; 132/901

[58] Field of Search ..... 132/122, 125, 132/139, 150, 158, 226, 261, 262, 901, 160

[56] References Cited

U.S. PATENT DOCUMENTS

| | | | |
|---|---|---|---|
| 82,982 | 10/1868 | Putton | 132/139 |
| 735,115 | 8/1903 | Kingman | 132/158 |
| 2,187,939 | 1/1940 | Holden | 132/160 |
| 2,507,373 | 5/1950 | Finkelstein | 132/139 |
| 2,576,618 | 11/1951 | Mansfield | 132/139 |
| 2,829,656 | 4/1958 | Pecovsky | 132/122 |
| 3,105,502 | 10/1963 | Mitchell et al. . | |
| 3,566,888 | 3/1971 | Bonarigo . | |
| 3,587,595 | 6/1971 | Popeil . | |
| 3,967,630 | 7/1976 | Zuhlsdorff et al. . | |
| 4,210,164 | 7/1980 | Sidelman . | |
| 4,569,360 | 2/1986 | Glucksman . | |
| 5,275,182 | 1/1994 | Northcutt . | |
| 5,911,226 | 6/1999 | Vecchiola et al. | 132/226 |

FOREIGN PATENT DOCUMENTS

| | | | |
|---|---|---|---|
| 325332 | 10/1902 | Germany . | |
| 1503335 | 12/1966 | Germany . | |
| 1782298 | 8/1971 | Germany . | |
| 2482842 | 11/1981 | Germany . | |
| 3605720 | 8/1987 | Germany . | |
| 9416240 | 12/1994 | Germany . | |
| 11386 | of 1890 | United Kingdom | 132/122 |
| 879632 | 10/1961 | United Kingdom . | |
| 941802 | 11/1963 | United Kingdom . | |
| 2081577 | 2/1982 | United Kingdom . | |
| 95/20339 | 8/1995 | WIPO . | |

*Primary Examiner*—Todd E. Manahan
*Attorney, Agent, or Firm*—Wall Marjama Bilinski & Burr

[57] ABSTRACT

A multi-comb hair-curler which has a body which includes a plurality of combs. One of the combs has pyramidal or conical teeth whose tips are distant from the body, with the teeth including at least once along their length, and on their opposite face, a narrowing which forms an open channel arranged between two adjacent teeth. The cross section of the channel is a circle or a polygon, the axis of which is perpendicular to that of the tooth and to that of the body which creates channels for retention of the ends of tie hair. The hair-curler further includes at least one comb with polygonal teeth of constant thickness without narrowing, with the combs being spaced alternatively in an equiangular manner to provide respectively, a comb with retention channels, and then a comb without retention channels.

3 Claims, 3 Drawing Sheets

Fig. 7
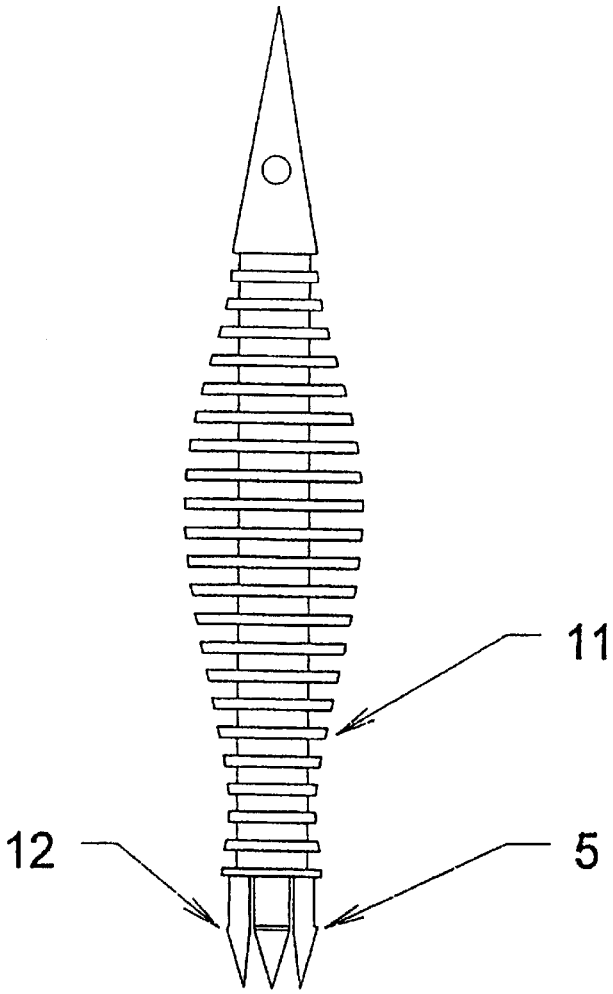
Fig. 6
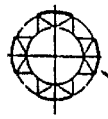
Fig. 5
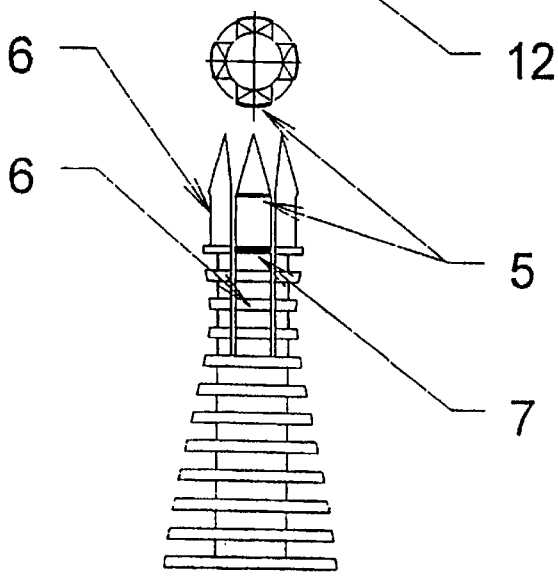
Fig. 4

SELF-FIXING MULTI-COMB HAIR-CURLER WITH RETENTION CHANNELS

BACKGROUND AND SUMMARY OF THE INVENTION

The invention relates to a multi-comb (1 and 8) hair-curler (9) equipped with hair-retention channels (2), which renders it self-fixing.

Attempts have been made for many years to create self-fixing hair-curlers. Various systems have been developed but, for the first tine, the invention presents a system with combs (1 and 8) whose teeth include, at their base, a channel (2) designed so as to retain the hair, both at the start of rolling (ends of the hair) and at the end of rolling, for fixing.

Retention systems for the ends of the hair (start of rolling) have hitherto been designed either with the aid of paper for covering the ends of the hair, or elastic bands, or brushes, or Velcro. As regards fixing, this is provided by elastic bands, spikes or clips. No system combines both retention of the ends of the hair and fastening of the hair-curler itself.

The system of channels (2) has the advantage of contributing both to retention of the ends of the hair and to the final fixing of the hair-curler.

Because these retention channels (2) allow the hairs to slide gently during rolling, the hair scales are, at the same time, stroked down, resulting in a beneficial, smoothing effect which prevents the hair from becoming charged with static electricity.

The object of the invention is to solve, at one and the same time, the dual problem of fastening the ends of the hair and of fastening the hair-curler, while eliminating the problem of the hair being rendered electrically charged through the aggressive nature of the materials fixing it by means of rough methods.

In accordance with the invention, this object is achieved by means of retention channels (2) located at the base of the teeth of the combs (1 and 8) of the hair-curler, these channels (2) being designed so as to receive the hairs gently and to retain them therein by means of their special shape.

In addition to its simple, practical and effective nature, the invention also presents an economic advantage in that it allows a significant time-saving since its autonomous nature does not require it to be handled twice The hair-curler (9) is complete in itself, without accessories to retain the ends of the hair nor for fixing it at the root.

It consists of a modern material and may be obtained by means of injection-moulding, which should guarantee that its manufacturing cost is reasonable.

BRIEF DESCRIPTION OF THE DRAWINGS

FIG. 4 is a second side sectional view of the handle member of the present invention;

FIG. 5 is a top sectional view of the connected member of FIG. 4.

FIG. 6 is a bottom sectional view of the notch connecting means of FIG. 7;

FIG. 7 is a side sectional view of the handle member of the present invention.

DESCRIPTION OF THE INVENTION

Figure 1:
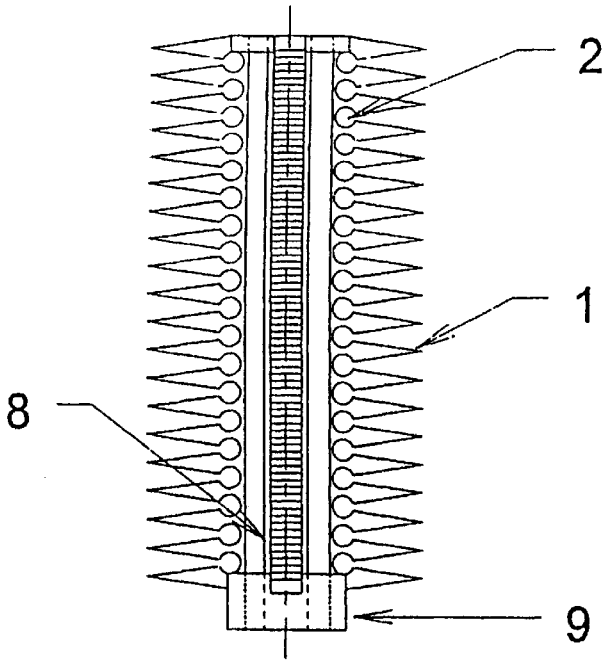
FIG. 1 is a side sectional view of one embodiment of the top of a hair-curler of the present invention.
Figure 3:
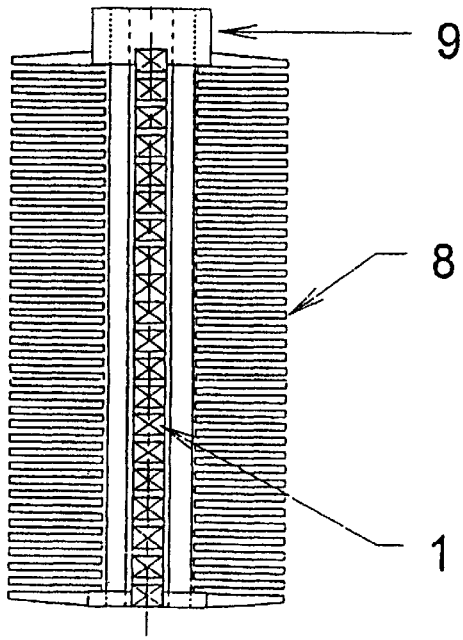
FIG. 3 is a side sectional view of the bottom of the hair curler of FIG. 1.

The invention is described below in five different forms, three of which are illustrated by means of a drawing:

1. Hair-curler, according to FIG. 1, to be used manually, Multi-comb hair-curler consisting of an oblong body, comprising at least two combs, characterized by the fact that at least one of the combs arranged around the body comprises pyramidal or conical teeth (1 and 8) FIG. 3, whose tips are distant from the body and, at least once along their length, a narrowing creating hair-retention channels (2).

Figure 2:
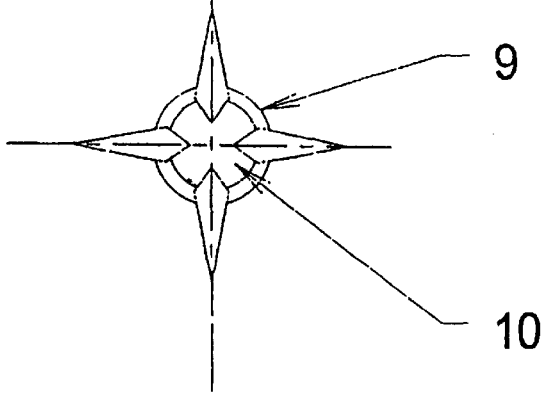
FIG. 2 is an end view of the hair curler of FIG. 1.
Figure 8:
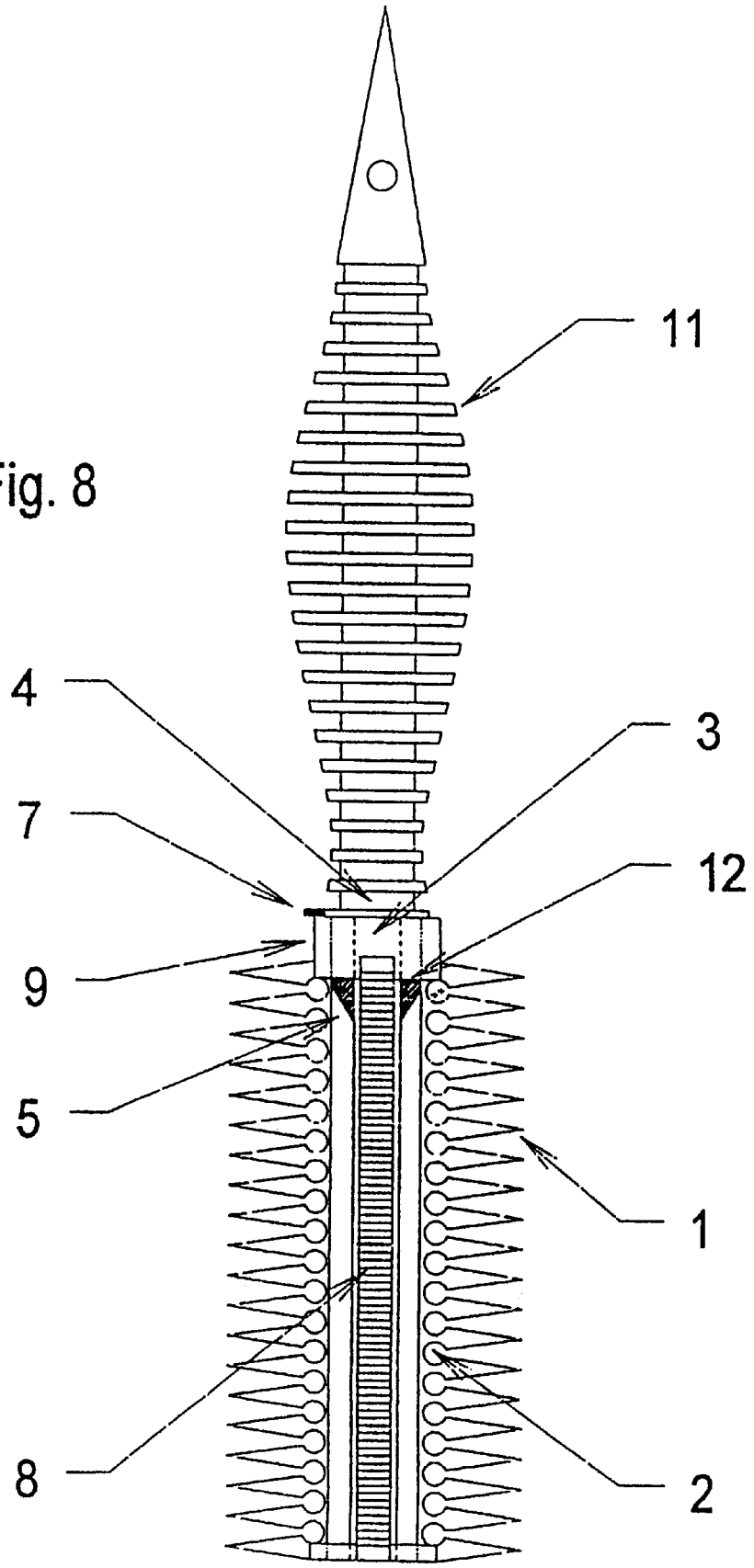
FIG. 8 is a side sectional view of the handle member and hair-curler member.

2. Hair-curler/brush, according to FIG. 8, fitted to a handle (11) by means of a snap-fit system (FIG. 4). The hair-curler (9) is presented just like the model described above but, in addition it is equipped with a system (FIG. 2) enabling it to be snap-fitted to a handle (11) by means of flexible, notched tabs (6) which converts it into a brush. When the hair-curler (9) is completely rolled and fixed, it suffices, by means of the notch (12), to reactivate the flexibility of the tabs (6) in order to separate the handle (11) from the hair-curler (9) FIGS. 5, 6, and 7, leaving the latter on the head for the time necessary for the hair style to stabilize. The handle (11) alone, without this first hair-curler (9), may then be fixed onto a new hair-curler (9) and then onto another in order to continue the work of styling the entire head of hair.

3. Hair-curler/brush, according to FIG. 8 used only as a brush. In the form described in Point 2, the invention can be used as a brush which makes it possible to carry out conventional blow-dried styling, with the advantage of allowing retention of the hair at any stage during its rolling. It may also be used for normal brushing of the hair, the simultaneous benefit being the smoothing effect on the scales and the elimination of static electricity.

4. Hair-curler heated by means of an integral heating body. The invention may also be implemented with an integral heating body, fixing of the ends of the hair and of the roots obviously remaining the same.

5. Hair-curler heated on an external heating body. The invention may also be implemented with the possibility of fastening on an external heating body, according to the traditional principle of the heated hair-curler, while still retaining the advantages of the retention channels (2) fastening both the ends of the hair and the hair-curler, avoiding all the other fixing means provided on existing heated hair-curler models.

What is claimed is:

1. A multi-comb hair-curler which comprises a body which includes four combs, with at least one of said combs having pyramidal or conical teeth whose tips are distant from the body, with said teeth including at least once along their length, and on their opposite face, a narrowing which forms an open channel arranged between two adjacent teeth, the cross section of which is a circle or a polygon, and the axis of which is perpendicular to that of the tooth and to that of the body which creates channels for retention of the ends of the hair, and with at least one comb with polygonal teeth of constant thickness without narrowing, with said combs being spaced alternatively in an equiangular manner, respectively, a comb with said retention channels, then a comb without retention channels.

2. A multi-comb hair-curler which comprises a body having at least two combs, with at least one of said combs having pyramidal or conical teeth whose tips are distant from the body, with said teeth including at least once along their length, and on their opposite face, a narrowing which forms an open channel arranged between two adjacent teeth, the cross section of which is a circle or a polygon, and the axis of which is perpendicular to that of the tooth and to that of the body which creates channels for retention of the ends of the hair, said hair curler further including means for being detachably engaged to a handle in order to form a brush, said handle having a snap fit which engages mortises located in the body of the hair-curler by means of a system of flexible tabs, at least one of which includes a notch with said notch being located in front of said tab which can be actuated.

3. A brush comprising a hair-curler according to claim 1, in which said notch is a stop notch which is released by means of a push-button.

* * * * *

UNITED STATES PATENT AND TRADEMARK OFFICE

CERTIFICATE OF CORRECTION

PATENT NO. : 6,047,704
DATED : April 11, 2000
INVENTOR(S) : Giuseppe Giordano

It is certified that error appears in the above—identified patent and that said Letters Patent is hereby corrected as shown below:

Title page, items, should read as following:

[87] PCT Pub. No.: WO97/46133

[30] Foreign Application Priority Data

June 3, 1996 [CH] SWITZERLAND . . . . . 1395/96

Signed and Sealed this

Tenth Day of April, 2001

*Attest:*

Nicholas P. Godici

NICHOLAS P. GODICI

*Attesting Officer*

*Acting Director of the United States Patent and Trademark Office*